US009691323B2

(12) United States Patent
Lee et al.

(10) Patent No.: US 9,691,323 B2
(45) Date of Patent: Jun. 27, 2017

(54) ORGANIC LIGHT EMITTING DISPLAY AND METHOD OF DRIVING THE SAME

(75) Inventors: Baek-Woon Lee, Yongin (KR); In-Hwan Ji, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 281 days.

(21) Appl. No.: 13/242,753

(22) Filed: Sep. 23, 2011

(65) Prior Publication Data

US 2012/0256936 A1 Oct. 11, 2012

(30) Foreign Application Priority Data

Apr. 8, 2011 (KR) ..... 10-2011-0032870

(51) Int. Cl.

| | |
|---|---|
| ***G09G 3/30*** | (2006.01) |
| ***G09G 5/36*** | (2006.01) |
| ***G09G 5/10*** | (2006.01) |
| ***G09G 3/3225*** | (2016.01) |

(52) U.S. Cl.

CPC ..... *G09G 3/3225* (2013.01); *G09G 2320/041* (2013.01); *G09G 2330/021* (2013.01); *G09G 2360/16* (2013.01)

(58) Field of Classification Search

CPC ... G09G 2320/0626; G09G 2320/0673; G09G 2330/021; G09G 2320/041

USPC ..... 345/76–83

See application file for complete search history.

(56) References Cited

U.S. PATENT DOCUMENTS

| | | | | |
|---|---|---|---|---|
| 2005/0117410 | A1 | 6/2005 | Shin | |
| 2007/0008297 | A1 | 1/2007 | Bassetti | |
| 2007/0080905 | A1* | 4/2007 | Takahara | G09G 3/3233 345/76 |
| 2009/0147032 | A1* | 6/2009 | Kim | 345/690 |
| 2009/0160880 | A1* | 6/2009 | Park | G09G 3/3233 345/690 |
| 2009/0195484 | A1 | 8/2009 | Lee et al. | |
| 2010/0103203 | A1* | 4/2010 | Choi | 345/690 |
| 2010/0253664 | A1* | 10/2010 | Byun et al. | 345/211 |

(Continued)

FOREIGN PATENT DOCUMENTS

| | | | |
|---|---|---|---|
| CN | 1728224 | A | 2/2006 |
| CN | 101499485 | A | 8/2009 |

(Continued)

OTHER PUBLICATIONS

Chinese Office Action dated Apr. 23, 2015.
Chinese Office Action dated Dec. 24, 2015.
Tawianese Office Action dated Mar. 9, 2016.

*Primary Examiner* — Kwin Xie

(74) *Attorney, Agent, or Firm* — Lee & Morse P.C.

(57) ABSTRACT

The organic light emitting display may include a plurality of pixels for generating light components with predetermined brightness components while controlling the amount of current that flows from a first power source to a second power source via organic light emitting diodes (OLED), a first power source controller for extracting data of the highest gray level among input data items of one frame and for outputting a control value having voltage information corresponding to the highest gray level data, and a first power source generator for generating a controlled voltage value corresponding to the control value and outputting the controlled voltage value to the first power source.

19 Claims, 7 Drawing Sheets

(56) References Cited

U.S. PATENT DOCUMENTS

| | | | | |
|---|---|---|---|---|
| 2011/0025671 | A1 | 2/2011 | Lee | |
| 2011/0043505 | A1* | 2/2011 | Ahn et al. | 345/211 |
| 2012/0044270 | A1 | 2/2012 | Arkhipov et al. | |

FOREIGN PATENT DOCUMENTS

| | | | |
|---|---|---|---|
| CN | 101989403 | A | 3/2011 |
| KR | 10-0589376 | B1 | 6/2006 |
| KR | 10-2007-0035388 | A | 3/2007 |
| KR | 10-2010-0045055 | A | 5/2010 |
| KR | 10-2012-0017968 | | 2/2012 |
| TW | 200709159 | A | 3/2007 |
| TW | 2009-35386 | A | 8/2009 |
| TW | 2010-23136 | A | 6/2010 |
| TW | 2010-30719 | A | 8/2010 |

* cited by examiner

ORGANIC LIGHT EMITTING DISPLAY AND METHOD OF DRIVING THE SAME

CROSS-REFERENCE TO RELATED APPLICATION

This application claims priority to and the benefit of Korean Patent Application No. 10-2011-0032870, filed on Apr. 8, 2011, in the Korean Intellectual Property Office, the entire content of which is incorporated herein by reference.

BACKGROUND

1. Field

Embodiments relate to an organic light emitting display and a method of driving the same. More particularly, embodiments relate to an organic light emitting display capable of reducing net power and a method of driving the same.

2. Description of the Related Art

Recently, various flat panel displays (FPD) capable of reducing weight and volume have been developed. Weight and volume are disadvantages of cathode ray tubes (CRT). The FPDs include a liquid crystal display (LCD), a field emission display (FED), a plasma display panel (PDP), and an organic light emitting display.

Among the FPDs, the organic light emitting display displays an image using organic light emitting diodes (OLED) that generate light by re-combination of electrons and holes. The organic light emitting display has high response speed and is driven with low net power. The organic light emitting display supplies currents corresponding to data signals to organic light emitting diodes (OLED) using transistors formed in pixels so that light is generated by the OLEDs.

SUMMARY

Embodiments are directed to an organic light emitting display and a method of driving the same.

An embodiment may be directed to an organic light emitting display, including pixels for generating light components with predetermined brightness components while controlling the amount of current that flows from a first power source to a second power source via organic light emitting diodes (OLED), a first power source controller for extracting data of the highest gray level among input data items of one frame and for outputting a control value having voltage information corresponding to the highest gray level data, and a first power source generator for generating the first power source having a voltage value corresponding to the control value.

The first power source generator includes a red extracting unit for extracting the highest gray level of red data among the input data items, a green extracting unit for extracting the highest gray level of green data among the input data items, a blue extracting unit for extracting the highest gray level of blue data among the input data items, a red voltage calculating unit for extracting the voltage corresponding the highest gray level of the red data, a green voltage calculating unit for extracting the voltage corresponding to the highest gray level of the green data, a blue voltage calculating unit for extracting the voltage corresponding to the highest gray level of the blue data, and a highest voltage extracting unit for selecting the highest voltage among voltages extracted by the red voltage calculating unit, the green voltage calculating unit, and the blue voltage calculating unit and for outputting the control value including information on the selected highest voltage.

The first power source generator includes a DC-DC converter for generating the first power source, a digital resistance for feeding back the voltage of the first power source to the DC-DC converter, and a resistance controller for controlling the resistance value of the digital resistance to correspond to the control value.

Another embodiment may be directed to a method of driving an organic light emitting display having pixels for controlling an amount of current that flows from a first power source to a second power source via organic light emitting diodes (OLED) includes a first step of receiving input data, a second step of determining the voltage value of the first power source to correspond to the highest level of the input data, and a third step of generating the first power source determined in the second step to supply the generated first power source to the pixels.

Another further embodiment may directed to a method of driving an organic light emitting display having a scan period in which data signals are input to pixels and an emission period in which the pixels simultaneously emit light, including a first step of determining the voltage of a first power source for supplying current to the pixels to correspond to red, green, and blue data of the highest gray levels of one frame, a second step of supplying a first power source having a uniform voltage value regardless of the first power source determined in the first step to the pixels in the scan period, and a third step of supplying the first power source having the voltage value determined in the first step to the pixels in the emission period.

BRIEF DESCRIPTION OF THE DRAWINGS

The above and other features of present embodiments will become more apparent to those of ordinary skill in the art by describing in detail exemplary embodiments thereof with reference to the attached drawings in which.

DETAILED DESCRIPTION

Korean Patent Application No. 10-2011-0032870, filed on Apr. 8, 2011, in the Korean Intellectual Property Office, and entitled: "Organic Light Emitting Display Device and Driving Method Thereof" is incorporated by reference herein in its entirety.

Example embodiment will now be described more fully hereinafter with reference to the accompanying drawings; however, they may be embodied in different forms and should not be construed as limited to the embodiments set forth herein.

Figure 1:
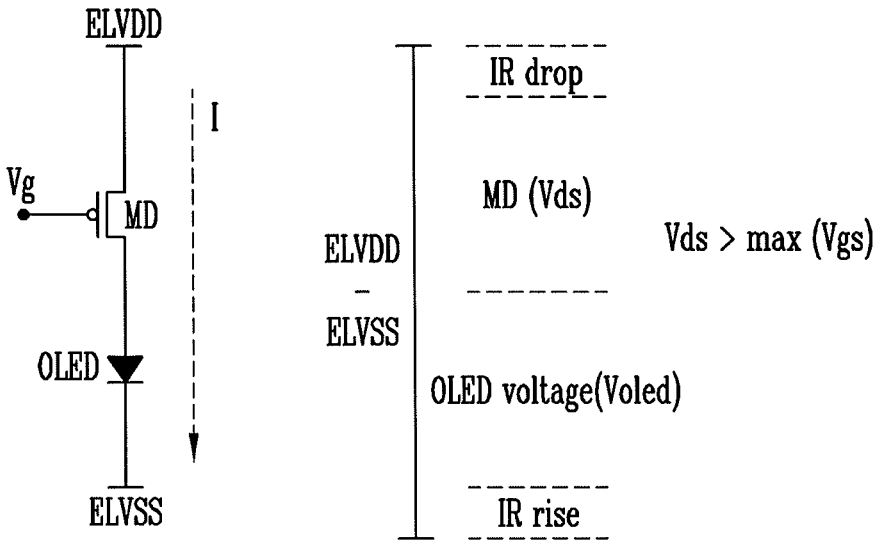
FIG. 1 is a view illustrating the range of a voltage applied to a pixel.

FIG. 1 is a view illustrating a range of a voltage applied to a pixel. In FIG. 1, for convenience sake, only the structures of a driving transistor and an organic light emitting diode (OLED) will be illustrated.

Referring to FIG. 1, a driving transistor MD and an OLED are serially coupled between a first power source ELVDD and a second power source ELVSS. In such a pixel, net power is set as the multiplication of current I that flows to the OLED by the first power source ELVDD. Here, since the first power source ELVDD is always uniform, net power is actually determined by the current I.

On the other hand, a part of power determined by the current and the first power source ELVDD is consumed by the emission Voled of the OLED and the remaining power is consumed by the joule heat of the driving transistor MD. Here, when a low gray level is displayed, power consumed by the OLED is reduced and power consumed by the joule heat of the driving transistor MD is increased. In this case, unnecessary power is consumed by the driving transistor MD and the temperature of a panel is increased so that the life of the panel is reduced. In addition, the voltage of the first power source ELVDD has to be increased in order to increase brightness enough. However, due to the above problem, the voltage of the first power source ELVDD may not be set to be high enough.

The voltages of the first power source ELVDD and the first power source ELVSS are set in consideration of the IR drop of the first power source ELVDD, the IR rise of the second power source ELVSS, an OLED voltage Voled, and the voltage Vds of the driving transistor MD.

The voltage Vds of the driving transistor MD is set to be higher than the gate-source voltage Vgs so that the driving transistor MD may be driven in a saturation region. In general, the voltage of the first power source ELVDD is set in consideration of the case in which the voltage of the highest gray level is applied to the gate electrode of the driving transistor MD. Therefore, when the gray level (for example, 0 to 255) of data is reduced (to be lower than 255), the gate-source voltage Vgs is reduced so that the voltage of the first power source ELVDD may be reduced. According to present embodiments, the voltage of the first power source ELVDD is controlled to correspond to the gray level of the data so that net power may be reduced.

Figure 2:
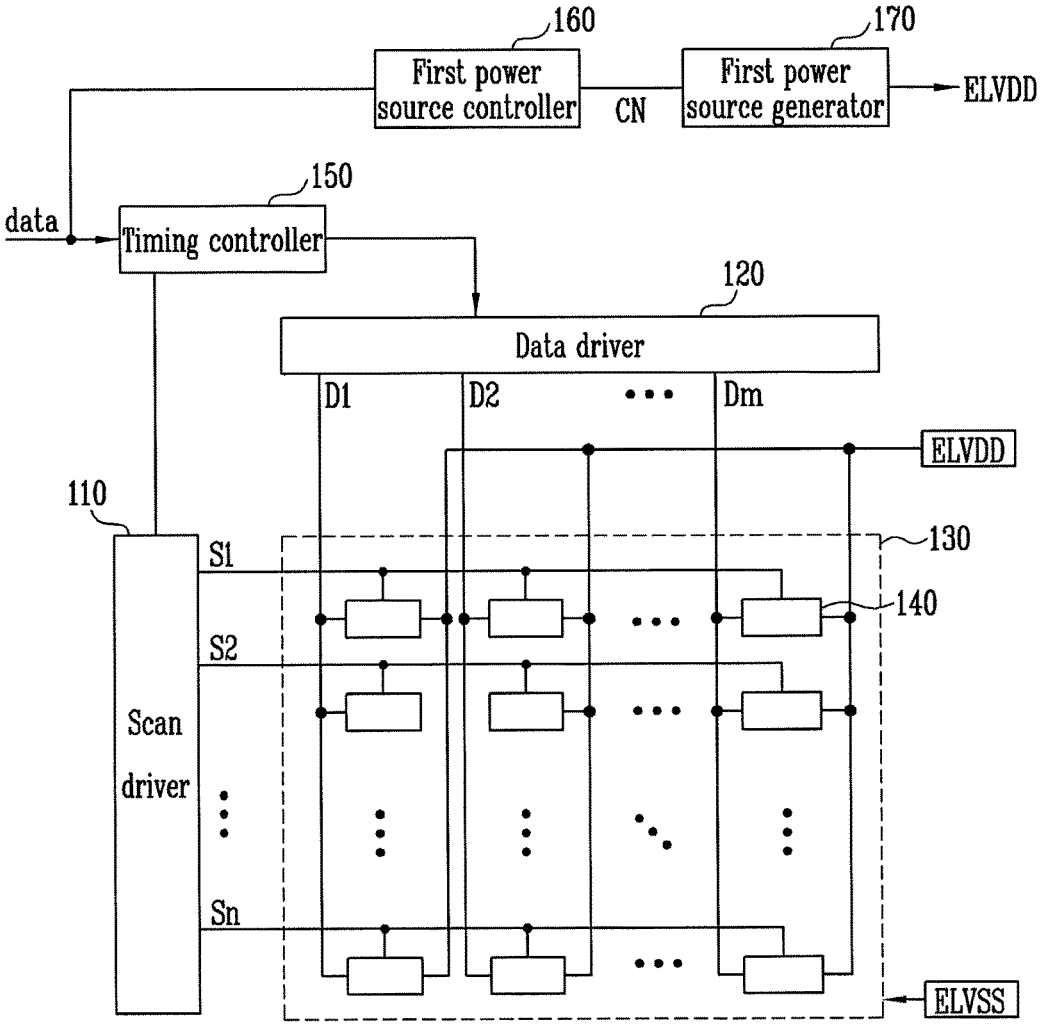
FIG. 2 is a view illustrating an organic light emitting display according to a first embodiment.

FIG. 2 is a view illustrating an organic light emitting display according to a first embodiment of present embodiments. In FIG. 2, a first power source controller 160 is formed outside a timing controller 150. However, present embodiments are not limited to the above. The first power source controller 160 may be formed in the timing controller 150.

Referring to FIG. 2, the organic light emitting display according to the first embodiment includes a pixel unit 130 including pixels 140 positioned at the intersections of scan lines S1 to Sn and data lines D1 to Dm, a scan driver 110 for driving the scan lines S1 to Sn, a data driver 120 for driving the data lines D1 to Dm, a timing controller 150 for controlling the scan driver 110 and the data driver 120, a first power source controller 160 for controlling the voltage of the first power source ELVDD to correspond to data, and a first power source generator 170 for generating the first power source ELVDD to correspond to the control of the first power source controller 160.

The pixels 140 receive the first power source ELVDD and the second power source ELVSS. Each of the pixels 140 generates light with predetermined brightness while controlling the amount of current that flows from the first power source ELVDD to the second power source ELVSS via the OLED to correspond to a data signal.

The scan driver 110 supplies scan signals to the scan lines S1 to Sn. When the scan signals are supplied to the scan lines S1 to Sn, the pixels 140 are selected in units of lines.

The data driver 120 supplies data signals to the data lines D1 to Dm in synchronization with the scan signals. The data signals supplied to the data lines D1 to Dm are input to the pixels 140 selected by the scan signals.

The timing controller 150 controls the scan driver 110 and the data driver 120. Then, the timing controller 150 transmits data from the outside to the data driver 120.

The first power source controller 160 extracts the highest gray levels of red data, green data, and blue data included in one frame and supplies the control values CN corresponding to the extracted gray levels to the first power source generator 170. The first power source controller 160 extracts the voltage values of the three first power sources ELVDD corresponding to the highest gray levels of the red, green, and blue data and supplies the control value CN corresponding to the largest voltage value to the first power source generator 170.

The first power source generator 170 generates the first power source ELVDD having the voltage corresponding to the control value CN and supplies the generated first power source ELVDD to the pixel unit 130.

That is, according to present embodiments, the highest gray level of the data in units of frames and generates the first power source ELVDD having the voltage corresponding to the extracted highest gray level to reduce net power.

Figure 3:
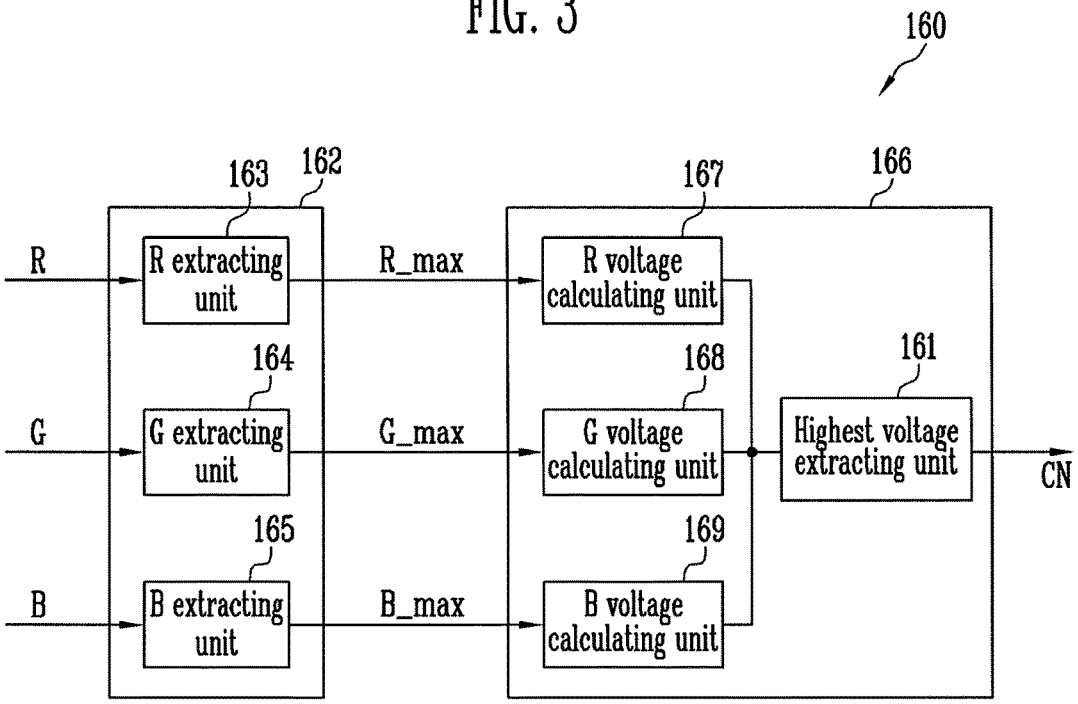
FIG. 3 is a view illustrating an embodiment of the first power source controller of FIG. 2.

FIG. 3 is a view illustrating a first power source controller according to an embodiment.

Referring to FIG. 3, the first power source controller 160 includes a highest gray level extracting unit 162 and a controller 166.

The highest gray level extracting unit 162 extracts red data R_max, green data G_max, and blue data B_max of the highest gray levels in units of frames. Therefore, the highest gray level extracting unit 162 includes a red R extracting unit 162, a green G extracting unit 164, and a blue B extracting unit 165.

The red extracting unit 163 receives red data R data among the data. The red extracting unit 163 that received the red data R data extracts the red data R_max having the highest gray level in one frame while comparing current data with previous data. For example, the red extracting unit 163 sequentially receives red data R data in one frame and may extract the red data R_max of the highest gray level while obtaining the value of a higher gray level between the gray level of the previous data and the gray level of the current data.

The green extracting unit 164 receives the green data G data among the data. The green extracting unit 164 that received the green data G data extracts the green data G_max having the highest gray level in one frame while comparing the current data with the previous data. For example, the green extracting unit 164 sequentially receives green data G data in one frame and may extract the green data G_max of the highest gray level while obtaining the value of a higher gray level between the gray level of the previous data and the gray level of the current data.

The blue extracting unit 165 receives the blue data B data among the data. The blue extracting unit 165 that received the blue data B data extracts the blue data B_max having the highest gray level in one frame while comparing the current data with the previous data. For example, the blue extracting unit 165 sequentially receives blue data B data in one frame and may extract the blue data B_max of the highest gray level while obtaining the value of a higher gray level between the gray level of the previous data and the gray level of the current data.

The data R_max, G_max, and B_max of the highest gray levels extracted by the highest gray level extracting unit 162 are supplied to the controller 166.

The controller 166 calculates the voltages corresponding to the data R_max, G_max, and B_max of the highest gray levels and transmits the highest voltage among the calculated voltages to the first power source generator 170 as a control value CN. Therefore, the controller 166 includes a red R voltage calculating unit 167, a green G voltage calculating unit 168, a blue B voltage calculating unit 169, and a highest voltage extracting unit 161.

The red voltage calculating unit 167 receives the red highest gray level data R_max and supplies the voltage of the first power source ELVDD corresponding to the received red highest gray level data R_max to the highest voltage extracting unit 161. For example, the red voltage calculating unit 167 may supply the voltage of the first power source ELVDD of 5V to the highest voltage extracting unit 161 to correspond to the gray level 158 R_max.

The green voltage calculating unit 168 receives the green highest gray level data G_max and supplies the voltage of the first power source ELVDD corresponding to the received green highest gray level data G_max to the highest voltage extracting unit 161. For example, the green voltage calculating unit 168 may supply the voltage of the first power source ELVDD of 3.2V to the highest voltage extracting unit 161 to correspond to the gray level 100 G_max.

The blue voltage calculating unit 169 receives the blue highest gray level data B_max and supplies the voltage of the first power source ELVDD corresponding to the received blue highest gray level data B_max to the highest voltage extracting unit 161. For example, the blue voltage calculating unit 169 may supply the voltage of the first power source ELVDD of 4V to the highest voltage extracting unit 161 to correspond to the gray level 125 B_max.

The highest voltage extracting unit 161 extracts the highest voltage (for example, 5V) among the voltage values supplied by the red, green, and blue voltage calculating units 167, 168, and 169 and supplies the control value CN corresponding to the extracted voltage to the first power source generator 170.

On the other hand, the voltage calculated by the first power source controller 160 may be set as the lowest voltage at which the driving transistor may be driven in a saturation region.

Figure 4:
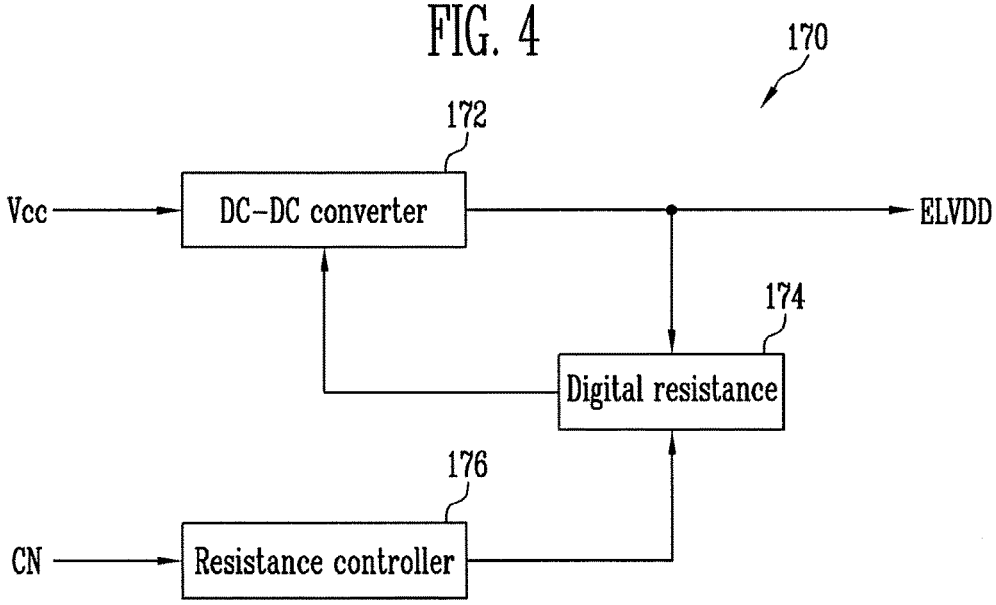
FIG. 4 is a view illustrating an embodiment of the first power source generator of FIG. 2.

FIG. 4 is a view illustrating a first power source generator according to the embodiment.

Referring to FIG. 4, the first power source generator 170 according to the embodiment includes a direct current-direct current converter (hereinafter, referred to as a DC-DC converter) 172, a digital resistance 174, and a resistance controller 176.

The DC-DC converter 172 receives an external power source Vcc and generates the first power source ELVDD using the received power source Vcc. The DC-DC converter 172 changes the voltage of the first power source ELVDD to correspond to the voltage fed back via the digital resistance 174.

The digital resistance 174 has a predetermined resistance value and has the resistance value changed by the control of the resistance controller 176.

The resistance controller 176 controls the resistance value of the digital resistance 174 to correspond to the control value CN supplied by the first power source controller 160.

When operation processes are described, the resistance controller 176 receives the control value CN corresponding to one frame from the first power source controller 160. For example, the resistance controller 176 may receive the control value CN corresponding to 5V from the first power source controller 160. The resistance controller 176 that received the control value CN controls the resistance value of the digital resistance 174 so that the first power source ELVDD of 5V is output to correspond to the control value CN. Then, the DC-DC converter 172 generates the first power source ELVDD of 5V to correspond to the voltage fed back from the digital resistance 174 and supplies the generated first power source ELVDD to the pixel unit 130.

As described above, according to present embodiments, the first power source ELVDD corresponding to the highest gray level among the data in one frame is generated to be supplied to the pixels 130 so that net power may be reduced.

Figure 5:
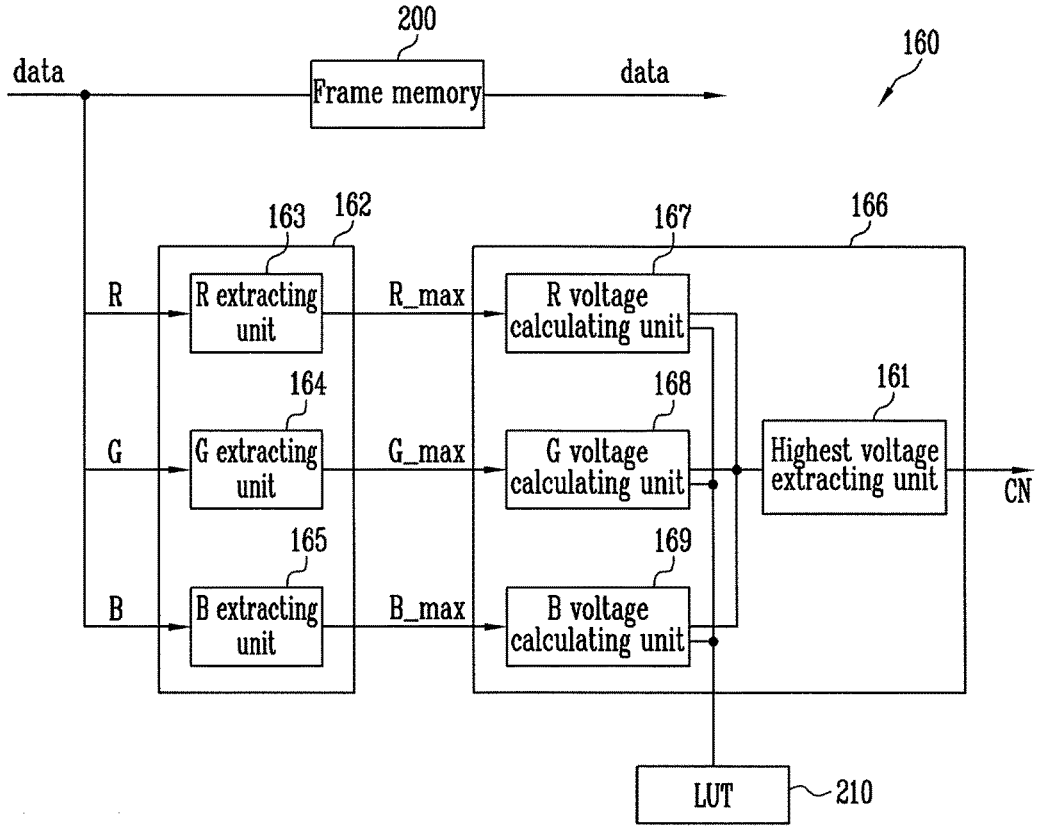
FIG. 5 is a view illustrating another embodiment of the first power source generator of FIG. 2.

FIG. 5 is a view illustrating a first power source controller according to another embodiment. When FIG. 5 is described, the same elements as those of FIG. 3 are denoted by the same reference numerals and detailed description thereof will be omitted.

Referring to FIG. 5, the first power source controller 160 according to another embodiment further includes a frame memory 200 and a lookup table (hereinafter, referred to as LUT) 210.

The frame memory 200 stores data from the outside of one frame and supplies the stored data to the timing controller 150. The frame memory 200 has the first power source ELVDD generated by the first power source generator 170 coincide with the data signal supplied to the pixel unit 130.

In detail, in the case where the first power source controller 160 is constructed as illustrated in FIG. 3, when the first power source ELVDD extracted from an ith (i is a natural number) frame is supplied to the pixel unit 130, the pixel unit 130 receives the data signal corresponding to an (i+1)th frame. That is, since the data signal of the ith frame is supplied to the pixels 130 in a period where the first power source controller 160 extracts the first power source ELVDD corresponding to the ith frame, the first power source ELVDD is delayed by one frame to be supplied to the pixel unit 130.

In general, the image displayed by the pixel unit 130 does not rapidly change so that the image may be stably displayed although the first power source ELVDD is supplied to be delayed by one frame in comparison with the data signal supplied to the pixel unit 130. According to the embodiment, in order to perform precise control, the frame memory 200 is added so that the first power source ELVDD and the data signal corresponding to the same frame may be supplied to the pixel unit 130.

The voltage values corresponding to gray levels are stored in the LUT 210. That is, the voltage values of the first power source ELVDD corresponding to the gray level values of the red, green, and blue gray levels (for example, 0 to 255) are stored in the LUT 210.

In this case, the voltage calculating units 167, 168, and 169 extract the voltage values of the first power source ELVDD corresponding to the data R_max, G_max, and B_max of the highest gray levels supplied thereto from the LUT 210 and supplies the extracted voltage values of the first power source ELVDD to the highest voltage extracting unit 168.

According to present embodiments, the voltage calculating units 167, 168, and 169 may calculate the voltage values of the first power source ELVDD as illustrated in FIG. 3 to correspond to the data R_max, G_max, and B_max of the highest gray levels or may extract the voltage values of the first power source ELVDD as illustrated in FIG. 5 to supply the voltage values of the first power source ELVDD to the highest voltage extracting unit 168.

Figure 6:
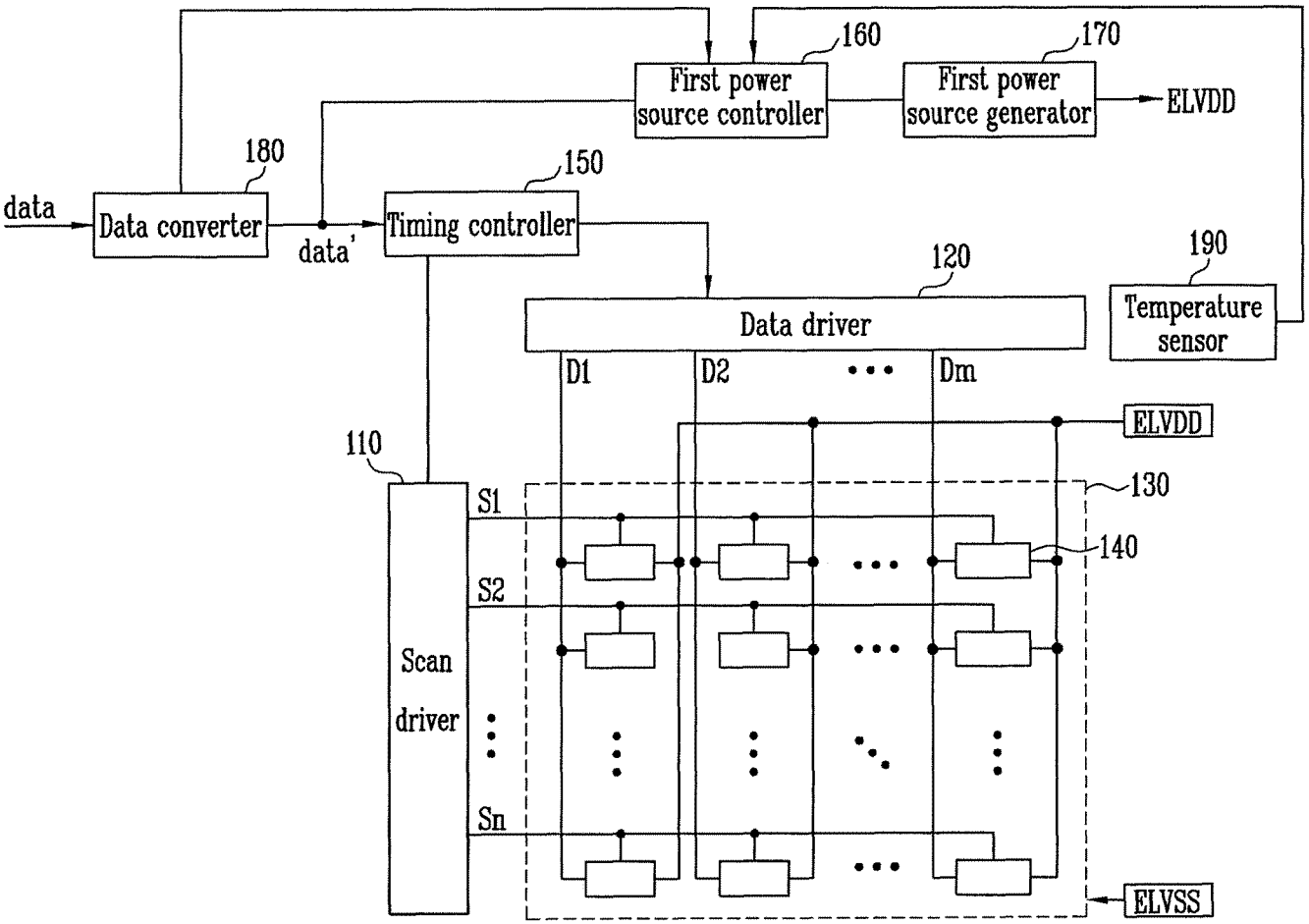
FIG. 6 is a view illustrating an organic light emitting display according to a second embodiment.

FIG. 6 is a view illustrating an organic light emitting display according to a second embodiment. When FIG. 6 is described, the same elements as those of FIG. 2 are denoted by the same reference numerals and detailed description thereof will be omitted.

Referring to FIG. 6, the organic light emitting display according to the second embodiment further includes a data converter 180 and a temperature sensor 190.

The data converter 180 changes the gray level value of input data to output changed data data'. The data converter 180 may be selected as a net power controller and a diming controller.

The net power controller changes the input data not to exceed the maximum current to be consumed in a previously set frame to generate the changed data data'. For example, the net power controller 180 receives the data of one frame and multiplies the data by the scale factor having a value larger than 0 and no more than 1 to generate the changed data data'. In this case, the changed data data' is set to have a lower gray level value than the input data. The diming controller used for reducing the brightness of a screen by the input of a user changes the gray level of the input data to generate the changed data data'.

Actually, according to present embodiments, the data converter 180 may adopt currently well known various structures by which the changed data data' is generated. In addition, the data converter 180 extracts the entire net current of the frame to correspond to the changed data data' and supplies the extracted net current to the first power source controller 160.

The temperature sensor 190 measures the temperatures of the panel and supplies the measured temperature to the first power source controller 160.

The first power source controller 160 receives the changed data data' and the net current from the data converter 180 and receives the temperature of the panel from the temperature sensor 190. Then, the first power source controller 160 generates the first power source ELVDD in consideration of the changed data data', the net current, and the temperature.

Actually, the first power source ELVDD to be supplied from the first power source controller 160 to a specific frame is illustrated in EQUATION 1.

$$ELVDD(n)=CN+Vt+Vir \quad \text{[EQUATION 1]}$$

wherein, the control value CN means the voltage value extracted by the gray level value of the changed data data' and Vt means a voltage value in accordance with temperature, and Vir means a voltage value in accordance with net current.

Here, the control value CN is extracted to correspond to the gray level value of the changed data data' as described with reference to FIGS. 2 to 5.

Vt means the voltage value corresponding to the temperature. Since the voltage of the OLED is reduced as the temperature increases, the voltage of the first power source ELVDD may change to correspond to the temperature.

Vir means the IR drop voltage corresponding to the net current of one frame.

In the first embodiment, the voltage of the first power source ELVDD is controlled to correspond to the control value CN without considering Vt and Vir. In this case, Vt and Vir are previously determined to fixed voltages to have uniform margin. However, in the second embodiment, the voltage of the first power source ELVDD is additionally controlled to correspond to the net current and the temperature so that net power may be reduced.

Figure 7:
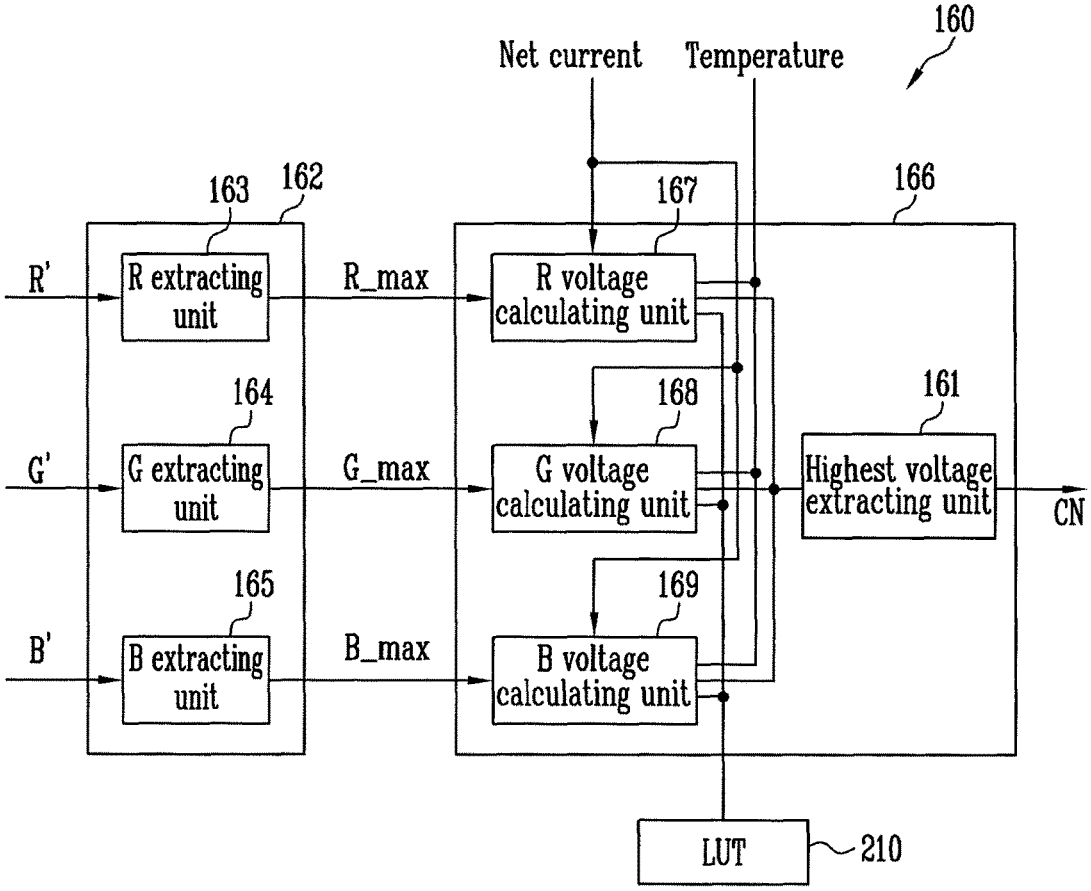
FIG. 7 is a view illustrating an embodiment of the first power source generator of FIG. 6.

FIG. 7 is a view illustrating the first power source controller of FIG. 6.

Referring to FIG. 7, the highest gray level extracting unit 162 receives changed data data': R', G', and B' and generates the highest gray level data R_max, G_max, and B_max corresponding to the changed data data': R', G', and B'. Since the operation processes of the highest gray level extracting unit 162 are the same as illustrated in FIG. 3, detailed description thereof will be omitted.

The red voltage calculating unit 167 receives the red highest gray level data R_max and supplies the received red highest gray level data R_max, the net current, and the first power source ELVDD corresponding to the temperature to the highest voltage extracting unit 161. At this time, the red voltage calculating unit 167 calculates the first power source ELVDD or extracts the first power source ELVDD from the LUT 210 illustrated in FIG. 5. Therefore, the voltages corresponding to the gray levels of the data items, the voltages corresponding to net currents, and the voltages corresponding to temperatures are stored in the LUT 210.

The green voltage calculating unit 168 receives the green highest gray level data G_max and supplies the received green highest gray level data G_max, the net current, and the first power source ELVDD corresponding to the temperature to the highest voltage extracting unit 161. At this time, the green voltage calculating unit 168 calculates the first power source ELVDD or extracts the first power source ELVDD from the LUT 210.

The blue voltage calculating unit 169 receives the blue highest gray level data B_max and supplies the received blue highest gray level data B_max, the net current, and the first power source ELVDD corresponding to the temperature to the highest voltage extracting unit 161. At this time, the blue voltage calculating unit 169 calculates the first power source ELVDD or extracts the first power source ELVDD from the LUT 210.

The highest voltage extracting unit 161 extracts the highest voltage among the voltage values supplied by the red, green, and blue voltage calculating units 167, 168, and 169 and supplies the control value CN corresponding to the extracted voltage to the first power source generator 170. Since the other operation processes are the same as illustrated in the first embodiment, description thereof will be omitted.

On the other hand, the above-described present embodiments may be applied to various types of driving methods such as a sequential driving method and a simultaneous driving method.

Figure 8:
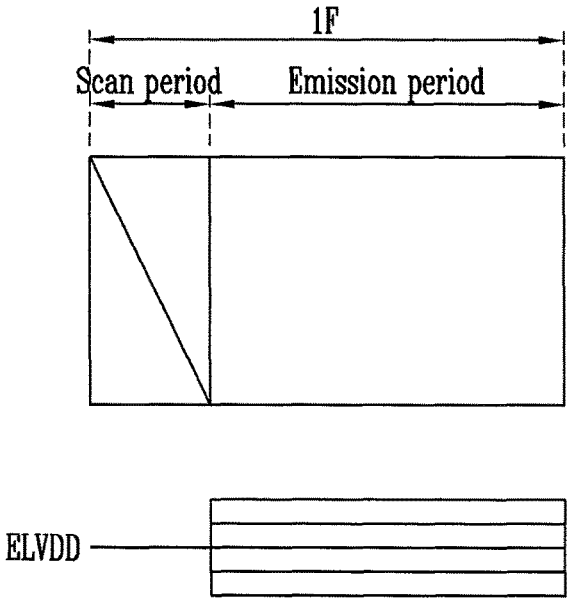
FIG. 8 is a view illustrating one frame period of a simultaneous driving method.

FIG. 8 is a view illustrating the case in which present embodiments are applied to the simultaneous driving method.

Referring to FIG. 8, in the simultaneous driving method, one frame period is divided into a scan period and an emission period.

In the scan period, the pixels 140 charge the voltages corresponding to the data signals. In the emission period, the pixels 140 generate the light components with the brightness components corresponding to the data signals.

Figure 9:
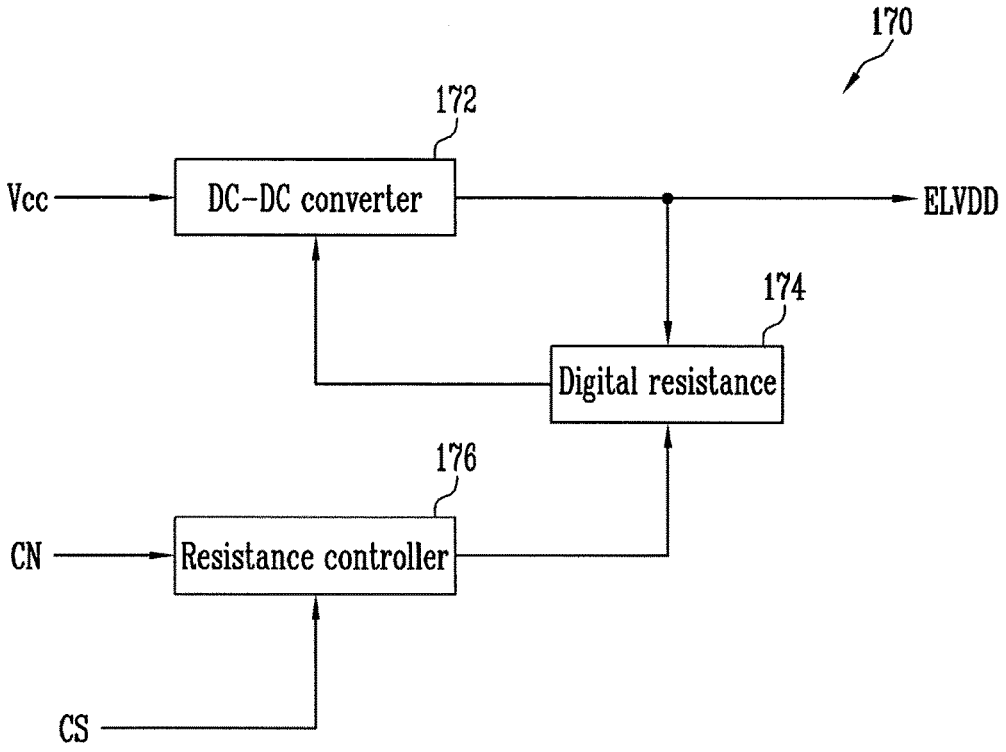
FIG. 9 is a view illustrating an embodiment of a first power source generator applied to the simultaneous driving method.

In the above simultaneous driving method, the resistance controller 176 included in the first power source generator 170 receives a control signal CS from the timing controller 150 as illustrated in FIG. 9. Scan period and emission period information items are included in the control signal CS.

In the scan period, the first power source generator 170 outputs the first power source ELVDD set to have uniform voltage regardless of the control value CN. Therefore, the resistance controller 176 controls the resistance value of the digital resistance 174 so that the first power source ELVDD of the uniform voltage is output.

In the emission period, the first power source generating unit 170 outputs the first power source ELVDD corresponding to the control value CN. Therefore, the resistance controller 176 controls the resistance value of the digital resistance 174 so that the first power source ELVDD corresponding to the control value CN is output.

Here, the voltage of the first power source ELVDD output from the first power source generator 170 supplied in the scan period may be set as an intermediate value in the voltage range of the first power source ELVDD that may be generated by the control value CN.

On the other hand, in the case where the voltage values of the first power source ELVDD are set to be different from each other in the scan period and the emission period, peak brightness may be improved. That is, since different first power sources ELVDD may be supplied in the scan period and the emission period, limitations on the voltage value of the first power source ELVDD that may be supplied in the emission period are removed. Therefore, in the emission period, the voltage of the first power source ELVDD is increased so that the peak brightness may be improved.

By way of summation and review, an organic light emitting display includes a data driver for supplying the data signals to data lines, a scan driver for sequentially supplying scan signals to scan lines, and a pixel unit including a plurality of pixels coupled to the scan lines and the data lines.

The pixels included in the pixel unit are selected when the scan signals are supplied to the scan lines to receive the data signals from the data lines. The pixels that received the data signals display an image while controlling the amounts of currents that flow from a first power source to a second power source via the OLEDs.

The voltage of the first power source that supplies the currents to the pixels is uniformly maintained. In this case, the voltage of the first power source is set to have enough voltage margin so that the currents may be stably supplied to the pixels. However, when the voltage of the first power source is set to have enough voltage margin, unnecessary power is consumed. In addition, when the voltage of the first power source is fixed, the peak brightness of a panel is limited.

When the voltage of the first power source is increased in order to increase the peak brightness of the panel, net power is increased and the life of the OLED is reduced due to heat generation.

Embodiments provide an organic light emitting display capable of reducing net power and a method of driving the same. In the organic light emitting display according to present embodiments and the method of driving the same, the voltage of the first power source is controlled to correspond to the gray level of data so that net power may be reduced. When the net power of the organic light emitting display is reduced, the temperature of the panel is reduced so that the deterioration speed of the OLED may be reduced. In addition, when the organic light emitting display is driven in the form of simultaneous emission, different first power sources may be supplied in a scan period and an emission period so that peak brightness may be improved.

Exemplary embodiments have been disclosed herein, and although specific terms are employed, they are used and are to be interpreted in a generic and descriptive sense only and not for purpose of limitation.

What is claimed is:

1. An organic light emitting display, comprising:

a plurality of pixels generating light, each pixel having an organic light emitting diode (OLED) having an anode provided with a first power source and a cathode provided with a second power source, each of the pixels controlling an amount of current that flows via the respective OLED;

a first power source controller to output a control value by extracting a highest gray level among respective gray levels of input data through comparing the respective gray levels of the input data, the control value including voltage information corresponding to the extracted highest gray level, the voltage information being determined based on the extracted highest gray level; and a first power source generator to generate the first power source, the first power source generator to control a level of the first power source in correspondence with the control value, wherein the extracted highest gray level is changeable according to the input data, wherein the first power source generator includes:

a DC-DC converter to receive an input voltage and a feedback voltage, and to generate the first power source;

a digital resistance to receive the first power source and to output the feedback voltage to the DC-DC converter; and a resistance controller to control a resistance value of the digital resistance to correspond to the control value, wherein the resistance controller receives a control signal corresponding to a scan period in which data signals are supplied by a timing controller and an emission period in which the pixels simultaneously emit light, and wherein:

the resistance controller controls the digital resistance so that the first power source is output at a uniform voltage in the scan period regardless of the value of the control value input to the resistance controller, and the resistance controller controls the resistance value of the digital resistance based on the value of the control value so that the first power source is output at a different level from the uniform voltage in the emission period.

2. The organic light emitting display as claimed in claim 1, wherein the first power source controller includes:

a red extractor to extract a highest gray level of red data among the input data;

a green extractor to extract a highest gray level of green data among the input data;

a blue extractor to extract a highest gray level of blue data among the input data;

a red voltage calculator to extract a red highest voltage corresponding to the highest gray level of red data;

a green voltage calculator to extract a green highest voltage corresponding to the highest gray level of green data;

a blue voltage calculator to extract a blue highest voltage corresponding to the highest gray level of blue data; and a highest voltage extractor to select a highest voltage among the red highest voltage, the green highest voltage, and the blue highest voltage, and to output the control value indicating the highest voltage among the red highest voltage, the green highest voltage, and the blue highest voltage.

3. The organic light emitting display as claimed in claim 2, wherein the first power source controller further comprises a frame memory to store the input data of one frame to output the input data.

4. The organic light emitting display as claimed in claim 2, further comprising a lookup table (LUT) to store voltage values of the red voltage, the green voltage, and the blue voltage corresponding to the highest gray level of red, green, and blue data.

5. The organic light emitting display as claimed in claim 4, wherein the red, the green, and the blue voltage calculators extract voltage values of the red voltage, the green voltage, and the blue voltage from the LUT to correspond to the highest gray level of red, green, and blue data supplied.

6. The organic light emitting display as claimed in claim 2, further comprising a data converter to change a gray level of data input from an outside to generate the input data.

7. The organic light emitting display as claimed in claim 6, wherein the data converter is one of a net power controller to restrict net power and a diming controller for controlling brightness.

8. The organic light emitting display as claimed in claim 6, further comprising a temperature sensor to measure temperature of a panel.

9. The organic light emitting display as claimed in claim 8, wherein the red, the green, and the blue voltage calculators add the red voltage, the green voltage, and the blue voltage corresponding to the highest gray level of red, green, and blue data to net power voltages corresponding to net power of one frame supplied by the data converter and temp voltages corresponding to the temperature to determine the highest voltage supplied to the highest voltage extractor.

10. The organic light emitting display as claimed in claim 9, further comprising a LUT to store the red voltage, the green voltage, and the blue voltage corresponding to the highest gray level of red, green, and blue data, temp voltages corresponding to the temperature, and net power voltages corresponding to the net power.

11. The organic light emitting display as claimed in claim 1, wherein the DC-DC converter controls the level of the first power source supplied to the anodes of the OLEDs in accordance with the resistance value of the digital resistance.

12. The organic light emitting display as claimed in claim 1, wherein the resistance controller controls the digital resistance so that the uniform voltage is an intermediate voltage in a voltage range of the first power source to be supplied in the emission period.

13. A method of driving an organic light emitting display having a plurality of pixels and a first power source generator including a DC-DC converter, a digital resistance, and a resistance controller, each pixel having an organic light emitting diode (OLED) having an anode provided with a first power source and a cathode provided with a second power source, each of the pixels to control an amount of current that flows via the respective OLED, the method comprising:

receiving input data;

extracting a highest gray level among respective gray levels of the input data through comparing the respective gray levels of the input data;

determining a control value having voltage information corresponding to the extracted highest gray level of the input data, the voltage information being determined based on the extracted highest gray level; and generating the first power source, a level of the first power source being controlled in correspondence with the control value, and supplying the first power source to the anodes of the OLEDs, wherein the extracted highest gray level is changeable according to the input data, wherein generating the first power source includes:

receiving an input voltage and a feedback voltage by the DC-DC converter, receiving the first power source and outputting the feedback voltage to the DC-DC converter by the digital resistance, and controlling a resistance value of the digital resistance to correspond to the control value by the resistance controller, wherein the resistance controller receives a control signal corresponding to a scan period in which data signals are supplied by a timing controller and an emission period in which the pixels simultaneously emit light, and wherein:

the resistance controller controls the digital resistance so that the first power source is output at a uniform voltage in the scan period regardless of the value of the control value input to the resistance controller, and the resistance controller controls the resistance value of the digital resistance based on the value of the control value so that the first power source is output at a different level from the uniform voltage in the emission period.

14. The method as claimed in claim 13, further comprising a step of changing a gray level of data input supplied from an outside to generate the input data.

15. The method as claimed in claim 13, wherein determining the control value includes:

extracting a highest gray level of red data, a highest gray level of green data, and a highest gray level of blue data from one frame;

extracting a red highest voltage corresponding to the highest gray level of red data, a green highest voltage corresponding to the highest gray level of green data, and a blue highest voltage corresponding to the highest gray level of blue data; and supplying a highest voltage among the extracted red highest, green highest, and blue highest voltages as the control value.

16. The method as claimed in claim 15, further comprising additionally controlling the voltages extracted for the highest gray level of red data, the highest gray level of green data, and the highest gray level of blue data to correspond to net power of one frame and temperature of a panel.

17. The method as claimed in claim 13, further comprising storing the input data in one frame to output the input data.

18. A method of driving an organic light emitting display having a plurality of pixels, each pixel having an organic light emitting diode (OLED) having an anode provided with a first power source and a cathode provided with a second power source, the display having a scan period in which data signals are input to the respective pixels and an emission period in which the pixels simultaneously emit light, the method comprising:

determining a first level of the first power source to correspond to a highest voltage among a highest gray level of red data, a highest gray level of green data, and a highest gray level of blue data of one frame;

supplying the first power source having a uniform voltage to the respective OLEDs in the scan period; and supplying the first power source having the first level, different from the uniform voltage, to the respective OLEDs in the emission period.

19. The method as claimed in claim 18, wherein the uniform voltage is an intermediate voltage in a voltage range to be supplied in the emission period.

* * * * *